US007896725B2

(12) United States Patent
Lo

(10) Patent No.: US 7,896,725 B2
(45) Date of Patent: Mar. 1, 2011

(54) BALANCING SYSTEM AND TURNING MECHANISM FOR REMOTE CONTROLLED TOY

(75) Inventor: Wai Chiu Lo, Kowloon (HK)

(73) Assignee: Silverlit Limited, Causeway Bay (HK)

( * ) Notice: Subject to any disclaimer, the term of this patent is extended or adjusted under 35 U.S.C. 154(b) by 682 days.

(21) Appl. No.: 11/685,944

(22) Filed: Mar. 14, 2007

(65) Prior Publication Data

US 2008/0227365 A1 Sep. 18, 2008

(51) Int. Cl.
*A63H 17/21* (2006.01)
*A63H 30/00* (2006.01)

(52) U.S. Cl. ..... 446/440; 446/454

(58) Field of Classification Search ..... 446/440, 446/457, 288, 275, 279, 233, 396, 431, 465, 446/454

See application file for complete search history.

(56) References Cited

U.S. PATENT DOCUMENTS 3,546,814 A * 12/1970 Melendez ..... 446/288
3,785,086 A * 1/1974 Escobedo ..... 446/440
3,826,038 A * 7/1974 Gentilini ..... 446/286
3,915,250 A * 10/1975 Laden et al. ..... 180/220
4,290,228 A 9/1981 Goldfarb et al.
4,342,175 A * 8/1982 Cernansky et al. ..... 446/440
4,563,164 A * 1/1986 Tao ..... 446/440
5,078,227 A * 1/1992 Becker ..... 180/221
5,368,516 A * 11/1994 Hoeting et al. ..... 446/288
5,709,583 A * 1/1998 Suto et al. ..... 446/440
5,865,267 A * 2/1999 Mayer et al. ..... 180/205
6,095,891 A * 8/2000 Hoeting et al. ..... 446/440
6,139,399 A * 10/2000 DeAngelis ..... 446/484
6,505,698 B1 * 1/2003 Miller ..... 180/219
2006/0276101 A1 12/2006 Mukaida

FOREIGN PATENT DOCUMENTS

WO WO 2004/056436 7/2004

OTHER PUBLICATIONS

International Search Report dated Aug. 13, 2008, from PCT/US2008/056627.

* cited by examiner

*Primary Examiner*—Gene Kim
*Assistant Examiner*—Alyssa M Hylinski
(74) *Attorney, Agent, or Firm*—Greenberg Traurig, LLP

(57) ABSTRACT

A radio controlled two wheeled vehicle incorporates a disposition of two motors, a gear system and electronics to provide a balancing and mobility during operation. There is a low center of gravity provided by relatively heavy wheels. The two-wheeled vehicle provides increased balancing at slower speeds between the drive system motors. In the motorbike, and a figurine having movable joints is attachable to the bike and provides for tilting of the bike and steering effects during the bike operation.

40 Claims, 7 Drawing Sheets

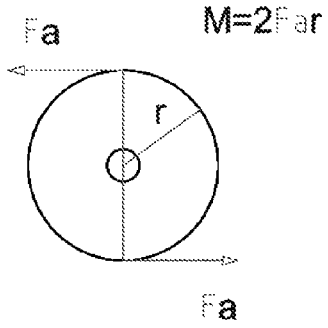
FIG. 2A
FIG. 2B
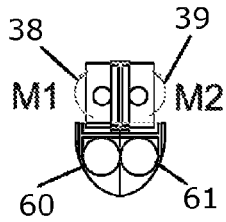
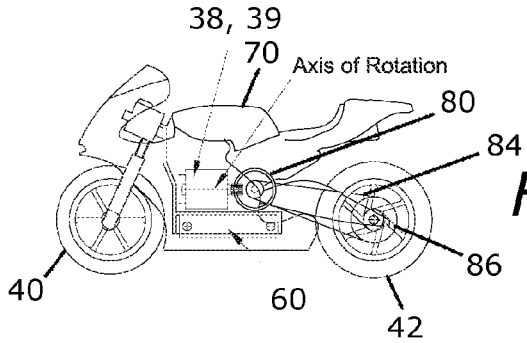
FIG. 2C
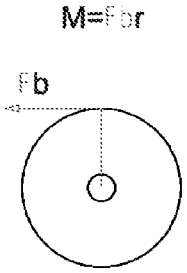
FIG. 3A
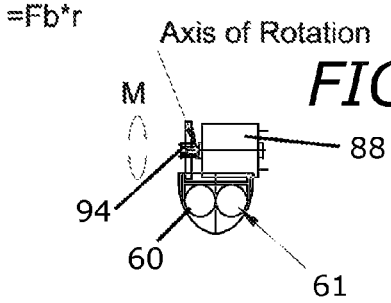
FIG. 3B
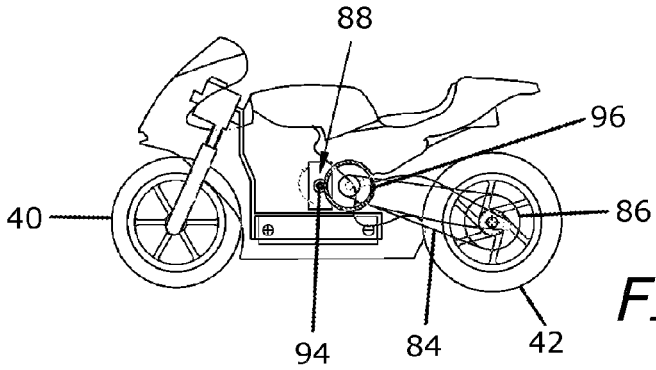
FIG. 3C

BALANCING SYSTEM AND TURNING MECHANISM FOR REMOTE CONTROLLED TOY

BACKGROUND

This disclosure relates to remote, and preferably radio, controlled toys. More particularly, the disclosure is concerned with a radio controlled two-wheeled vehicle such as a motorcycle or a bicycle.

Radio controlled or remotely controlled toys are popular toys. Radio controlled toys often attempt to emulate the standard vehicle configuration and incorporate radio control technology.

The configuration of radio-controlled toys is dependent on the power, transmission and other systems to operate the toy in a stable manner, and to permit the toy to perform dynamic maneuvers and actions while maintaining a balance for continuous operation of the toy.

Design considerations include the dimensions of the device, the mass, namely the power to weight ratio, of the toy and the location of the toy's center of gravity.

There is a need for a toy remote control motorcycle and more particularly a toy motorcycle which is radio controlled with respect to balance, speed and steering. Toy motorcycles or bicycles having two wheels present balance and steering problems which are complex and different from problems encountered with four wheeled radio controlled toy vehicles.

In some cases similar problems exist in other vehicles having less than four wheels to effect a normal spaced balanced relationship. The disclosure is also directed to toy vehicles having less than four wheels.

These problems with balance and steering in vehicles with less than four wheels have been approached in a number of different ways by the prior art, but none is really satisfactory.

SUMMARY

The disclosure provides a remote controlled vehicle, having less than four wheels, and preferably a two-wheel vehicle that incorporates technology to increase the balancing of the toy and thereby increase the playability, balancing and maneuverability of the toy.

The use of a balancing system increases the possibilities of different radio controlled toys and is implemented into a two wheeled vehicle to increase its balancing and thereby the range of maneuvers it can make during operation.

As such, it is desirable to provide a radio controlled two-wheeled vehicle, for instance, a motorbike or bicycle that is capable of simulating the balance provided by a human rider in a real bicycle, and performing various dynamic movements, while maintaining a balance during operation.

The disclosure includes a two wheel radio controlled vehicle having power, balancing and drive systems to enable a variety of actions, and a unique disposition of a balancing system for the two wheeled vehicle.

The wheels are formed of a relatively heavy material that relatively lowers the center of gravity of the vehicle, and increases the balancing ability and permits effective steering motion.

In one form the two-wheeled radio controlled toy vehicle, such as a motorbike, includes a chassis having front and rear ends and a central portion between the ends and front and rear wheels operatively connected to and providing support for the respective front and rear ends. A front wheel fork assembly is operatively connected to the front end of the body and rotatably supports the front wheel of the motorbike.

A steering mechanism is such that the wheels are relatively locked or retained in alignment with the longitudinal axis. Steering is effected by the tilting of the vehicle relative to the vertical. A drive system selectively drives the rear wheel of the toy vehicle in response to radio commands received from a user operated remote transmitter.

A balancing system has a drive and transmission from the drive motor system to increases the balancing of the toy vehicle during operation.

There is electronic circuitry and a power supply for operating the drive, balancing and steering in response to user received radio commands from a remote transmitter.

Features of the present disclosure will become apparent from the following detailed description considered in conjunction with the accompanying drawings. It is to be understood, however, that the drawings are designed solely for purposes of illustration and not as a definition of the limits of the disclosure, for which reference should be made to the appended claims.

DRAWINGS

The above-mentioned features and objects of the present disclosure will become more apparent with reference to the following description taken in conjunction with the accompanying drawings where like reference numerals denote like elements and in which:

FIG. 2A is a diagrammatic view of the forces applicable to bike where there are two motors;

FIG. 2B is a sectional transverse view through the bike showing the location of the batteries and the two motors;

FIG. 2C is a side view through the bike showing the location of the batteries and the two motors;

FIG. 3A is a diagrammatic view of the forces applicable to bike where there is one motor;

FIG. 3B is a sectional transverse view through the bike showing the location of the batteries and one motor;

FIG. 3C is a side view through the bike showing the location of the batteries and one motor;

DETAILED DESCRIPTION

Figure 1A:
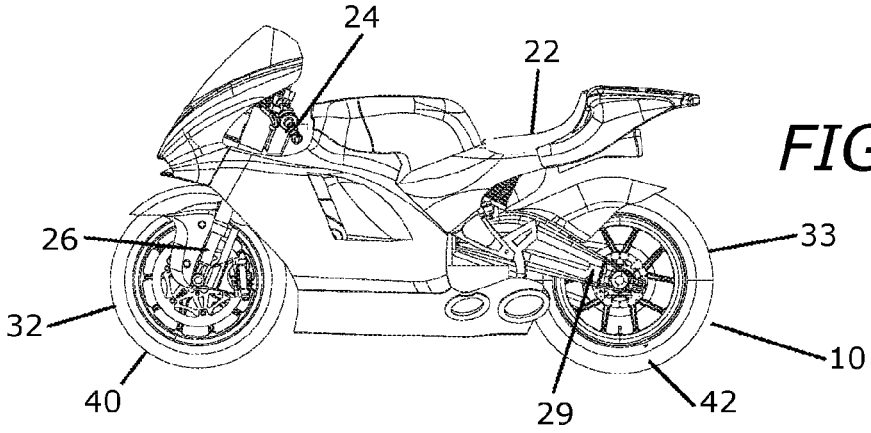
FIGS. 1A-1D are respectively side, top front, and rear views of a motorcycle.
Figure 1B:
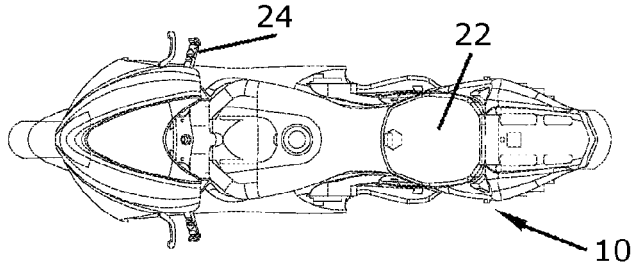
Figure 1C:
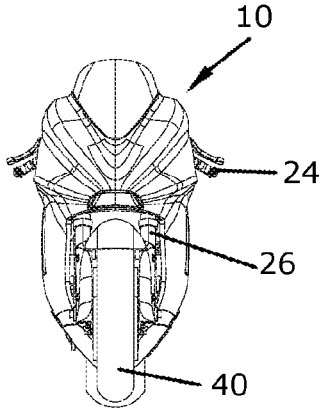
Figure 1D:
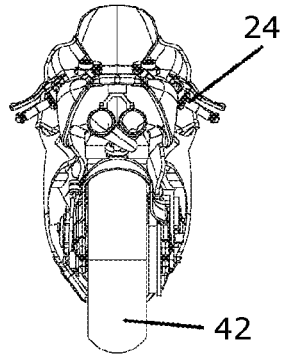

A remote controlled toy motorcycle includes a RF transmitter, and is about a 1:12 scale motorcycle. It also includes in with the RF transmitter a battery charger. The toy motorcycle dimension are around 172 mm (length)×85 mm (height)×52 mm (wide).

The toy vehicle, namely the motorcycle, comprises spaced apart wheels, and the wheels are relatively aligned in a longitudinal axis defined by a straight movement. There is a chassis between the wheels. The vehicle is capable of being inclined from a relatively vertical position to tilt to the left or right according to corresponding turning action to the left or right of the vehicle. A motor turns at least one wheel. A receiver receives control signals to regulate the motor, and the signals being from a remote RF transmitter.

Each of the wheels is formed of a relatively heavy material thereby to have a relatively low center of gravity for the vehicle. A front and rear rim are a relatively heavy alloy or metal, selectively copper, cast iron or steel thereby to lower the CG. These rims rotate at relatively high speed, and create a stable axis of rotation, namely a tendency to maintain its plane of rotation. When the wheels are tilted, there is a twisting moment induced about an axis at 90 degrees to that of the original tilt effectively by a gyroscopic precession. The gyroscopic effect is applied on both wheels, thereby making the performance of the vehicle.

A symmetric design of actuators permits the motorcycle to perform an effective balance at relatively low speed. The vehicle uses two relatively small dc motors placed in parallel and symmetrical relationship along a motorcycle longitudinal axis. The weights are relatively symmetrically distributed in left and right portion and the motors rotate in different directions. The dual motor system provides stable output torque in high or low speed operation.

The vehicle drive includes a constant voltage source for a motor with a selectively variable on/off duty cycle, selectively being Pulse Width Modulation (PWM) being applied to control the speed of the motor. A lower PWM ratio, a lower power input, and a lower the efficiency of motor provides a torque output.

A dual motor system has both motors run relatively fast at high-speed operation. In a low speed operation, both motors are on and off alternatively at medium to high PWM.

The toy vehicle, namely the motorcycle, includes having a relatively fixed and non-turnable handlebar and an offset CG turning reaction.

The player operates a transmitter to remotely control the vehicle. The stability is effected by the handle bar that is not capable of turning, and an angle of lean permits movement of the front tire contact patch towards the leaned side. The resultant force of centrifugal force and gravitational force passes this patch area and maintains the balance while turning. The angle is about 66 to about 70 degrees and thereby reduces the turning angle and permits controlled turning performance.

The motorcycle, and an offset of the center of gravity turning essentially matches a no handle-bar turning control. There is a driver figurine with a representative driving technique. When the driver's body leans toward one side. This is affected by the leaning by pulling the driver's thigh away from the motorcycle's body by a gear system. When the driver movement shifts the overall CG from a longitudinal axis to a leaned side, the motorcycle tends to lean towards the direction.

The use of gyroscopic precession causes a front wheel to make a turn, such that a relatively smooth turning process is obtained without a need to essentially change the driving speed at initiation of the turn to effect the control process.

The vehicle includes a control by at least one of infrared remote control, radio frequency remote control, a programmable control or a battery operated wire control.

The dual motor system has the motors being placed in parallel, along the longitudinal axis, namely a centerline, and rotated in opposition directions. They drive a power transmission system.

The power transmission system has a double-sided crown gear, and a metal or plastic belt and an embedded gear on the rear wheel, and the dual motor system for generating power. The power is transmitted to a transverse axis by the double-sided crown gear and pinions on the motors. The power is transmitted to a rear wheel through the belt connected between the embedded gear on the rear wheel and the crown gear.

The front wheel is free to rotate along the wheel axis and steering axis and there is no additional actuator or mechanism required to change the direction of front wheel along the steering axis.

The figurine can have having free hinges between selected limbs, selectively the elbows, arms, thighs and knees, being placed on the motorcycle. Both hands are located on a handlebar, and the handlebar is unmovable and mounted on the vehicle body. The figurine has shoulders, arms, legs, hands, feet, a body, a plurality of joints in the shoulders, arms, legs, hands, feet and body and the figurine is movable relative to the body of the vehicle. There can be joints, being selectively at least one of a shoulder joint where the arms meet the body, a hip joint where the legs meet the body, and knee joints in the legs.

A shifting of the figurine body effects a change in CG to one side with an actuator, such that the motorcycle can perform a matching turning. The actuator for shifting the figurine body includes at least one of an electric motor, electromagnetic device or ionic polymer actuator.

The motorbike is an auto-stable system, and is such that no feedback signal is needed for a player to facilitate balance of the motorcycle.

The turning and balancing system operates with a remote controlled motorcycle, or a three-wheel vehicle, namely with a sidecar, or a remote controlled other two-wheel vehicle or a bicycle.

The remote controlled two-wheeled toy vehicle comprises a body having a chassis with front and rear ends and a central portion between the ends. Between the front end and the rear end there is a longitudinal axis. A front wheel fork assembly is connected to the front end of the body, and there are non-moveable handlebars connected to the front wheel fork assembly. The front and rear wheels are operatively connected to and providing support for the respective front and rear ends. The front wheel is rotatable mounted on the front wheel fork assembly. The front and rear wheels are directed along the longitudinal axis, and the wheels are non-turntable from the longitudinal axis, namely they are relatively locked or retained in alignment with the longitudinal axis. Steering is effected by the tilting of the vehicle relative to the vertical.

The toy vehicle is steerable in a desired direction under the effect of a tilt relative to a vertical axis passing through the vehicle.

Circuitry receives signal commands from a remote transmitter and controls the motors in response to received signal commands. A power supply is disposed on the chassis for providing power to the circuitry and the motors. The power supply comprises batteries disposed in an housing for providing power to the circuitry, and the circuitry includes a circuit board.

The motor system operates a wheel, and circuitry receives remote commands from a remote transmitter and controls the toy vehicle in response to received remote commands. A power supply with the body provides power to the circuitry:

and the turning of the vehicle is affected by relatively tilting the vehicle from a position of vertical.

The balancing system is user controllable by the remote transmitter and the circuitry.

Balance Theory

The basic balance principle can be classified into two preferred parts which are:

(1) A low Center of Gravity (CG) height design; and (2) Symmetric design of actuators.

Based on the requirement of (1), front and rear rim were made by heavy alloy or metal such as copper, cast iron or steel which can lower its CG. Besides, when these rims rotate in high speed, they can create a very stable axis of rotation, i.e., a tendency to maintain its plane of rotation.

Figure 1E:
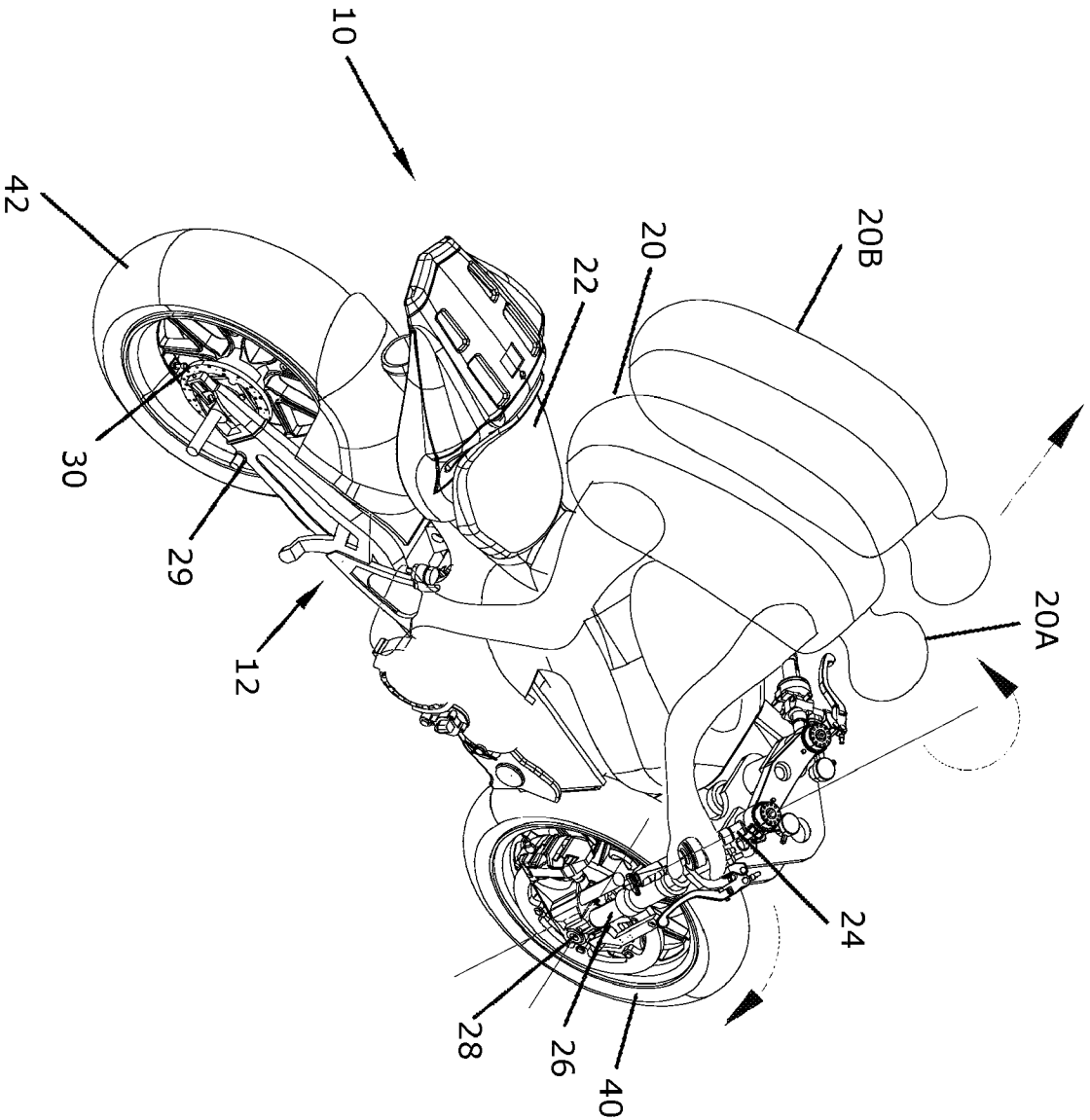
FIG. 1E is a perspective view of a motorcycle also illustrating a figurine on the bike and a different relative position of the figurine.

When the wheels are tilted, a twisting moment is induced about an axis at 90 degrees to that of the original tilt. This is gyroscopic precession. This gyroscopic effect increases when the spinning speed becomes faster. Consider a motorcycle that travels along a straight path and starts to fall to the left under unknown external influence: because of gyroscopic precession of the front wheel, it turns to the left automatically. The motorcycle will begin to turn left which exerts a centrifugal force (rightward force) to the motorcycle. This force tend to restore the motorcycle back to the vertical position as shown in FIG. 1E.

In one form, the toy motorcycle applies both heavy rims on a remote controlled motorcycle. The motorcycles employ heavy front rim and rear rim design. By applying gyroscopic effect on both wheels, the performance of motorcycle is relatively more stable and easier to balance by itself.

Figure 2D:
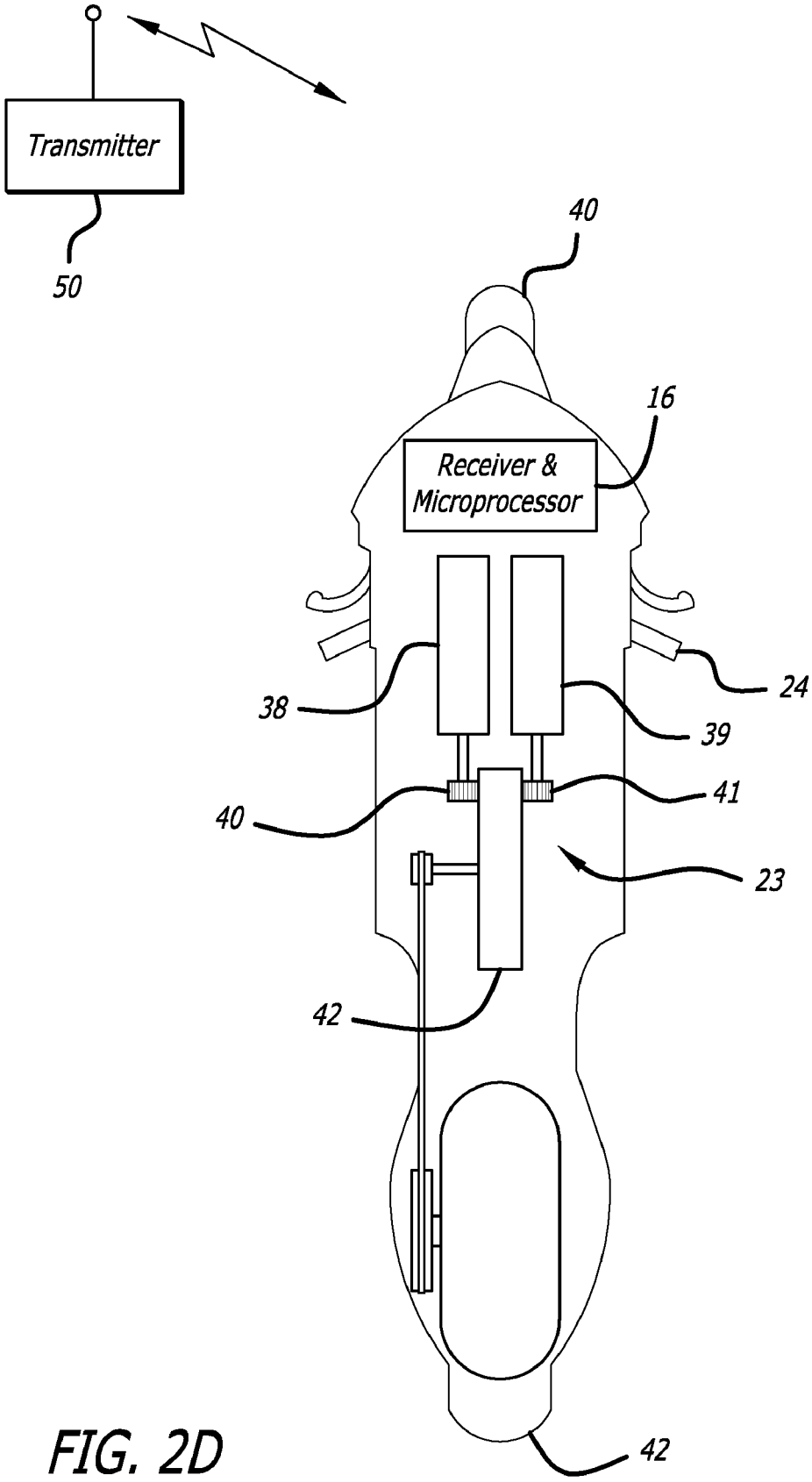
FIG. 2D is a top view through the bike showing the location of the batteries and the two motors, and the transmitter and receiver.

With the above features, there is also preferably the use of (2) "Symmetric design of actuators". The motorcycle performs an enhanced balance performance even at relatively low speed. This design preferably uses two small dc motors are placed in parallel and symmetrically along the motorcycle longitudinal axis (FIG. 2B). As such the weights are symmetrically distributed in left and right portion. Also, each motor are rotates relative to the other in different directions.

The advantages include the following:

a. Dual motor system can provide stable output torque in high or low speed operation. In a real full-size motorcycle, the speed of motorcycle is controlled by a manual or automatic transmission system. By changing the gear ratio inside the gearbox, different torques output and speeds could be obtained. In a remote controlled motorcycle in terms of the disclosure, there is no ideally no need for a complicated transmission system, and the gear ratio is fixed. A constant voltage is applied with various on/off duty cycle, known as Pulse Width Modulation (PWM) method, to control the speed of motor. The lower the PWM ratio, the lower the power input, the lower the efficiency of motor and hence the torque output will fluctuate or in worst case, the motor will be stalled by small external force.

In a single large motor system (FIG. 3C), it works better at higher speed but less relatively less effectively at low speed because the PWM ratio may be too low at low speed driving.

On the other hand, in dual motor system, both motors are running relatively fast at a high-speed operation. In low speed operation, both motors are on and off alternatively at medium to high PWM, then, the overall input to the gearbox is very smooth and the motors can still keep operating at high efficiency level and constant torque. This principle is similar to stroke cycle on internal combustion engine. Four-stroke cycle one is better than that of two-stroke cycle model.

b. Assume the torque that needed to drive the motorcycle is T. In a single motor system, the required torque output is T but in dual motor system, each motor contributes only T/2 which is easy to be achieved by small electric motor (FIGS. 2A, 3A).

c. From Newton's 3rd law of force and reaction force, while the motor is rotating, a force is generated on motor shaft. A reaction force and hence torque is exerted on motor itself so that it will tend to rotate in opposition direction.

In single motor system, this unwanted torque may affect the equilibrium and become less balanced in heavy loading condition such as driving uphill. In a dual motor system, the reaction torques from the motors are cancelled by each other because both motors are rotating in same speed but opposite direction. Hence essentially zero resultant force/moment is exerted on the motorcycle to influence its stability (FIGS. 2B, 3B).

d. Where a remote controlled motorcycle, a single motor system is applied and the motor is placed horizontally i.e. perpendicular to longitudinal axis, the motorcycle moves straight in an acceptable manner. It may become relatively unstable in low speed turning. The internal structure of a motor includes an armature inside the motor, also a fast spinning object. It also generates a gyroscopic effect.

In low driving speed operations, the gyroscopic precession effect is comparatively small from wheels but still high inside the motor. When the driver leans left, the motorcycle will turn left automatically. The turning angle can become more than expected due to the gyroscopic effect from motor and the centrifugal force is not large enough to compensate this small turning radius. As a result the motorcycle can fall down while low speed turning unless the driving speed is increased simultaneously.

Turning Principle

The turning principle of this motorcycle can be classified into (1) no handle-bar turning control, and (2) Offset CG turning method.

For the remote controlled motorcycle, a player or user uses a transmitter to remotely control the motorcycle. There is no feedback system from the motorcycle to indicate information to the player about its stability status and therefore the player is not able to correct the motorcycle's motion when the motorcycle loses its balance. This difficulty is addressed and the motorcycle itself made auto-stable by the following features.

(1) No Handlebar Turning Control.

Figure 4:
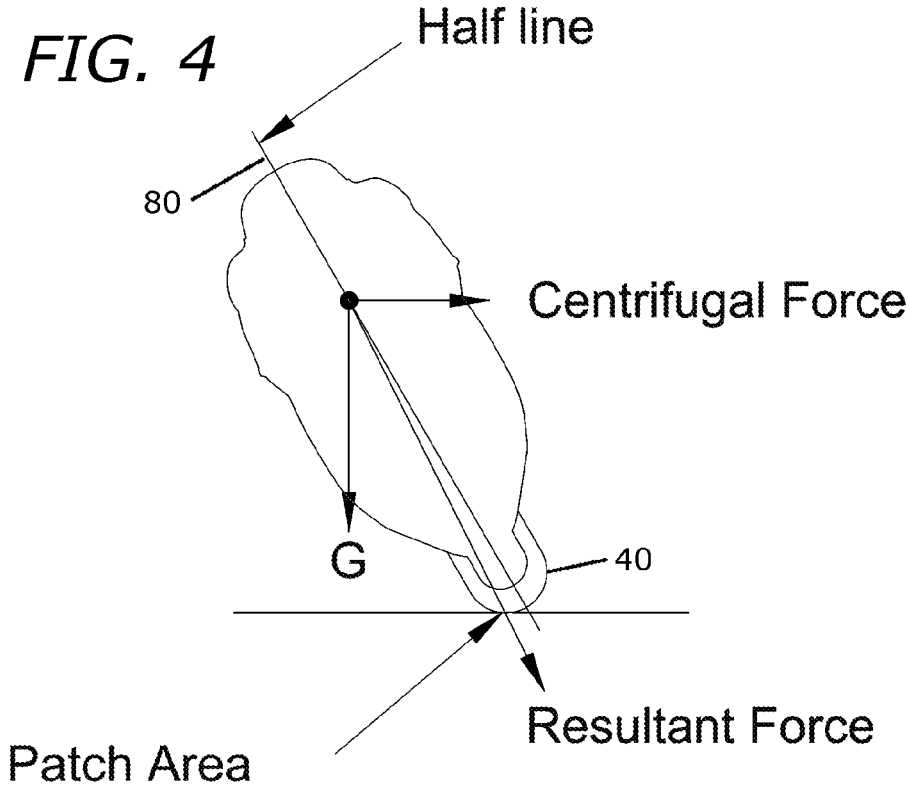
FIG. 4 is a front diagrammatic view of a motorcycle on the bike, the bike being directed in a tilted sense direction.
Figure 5:
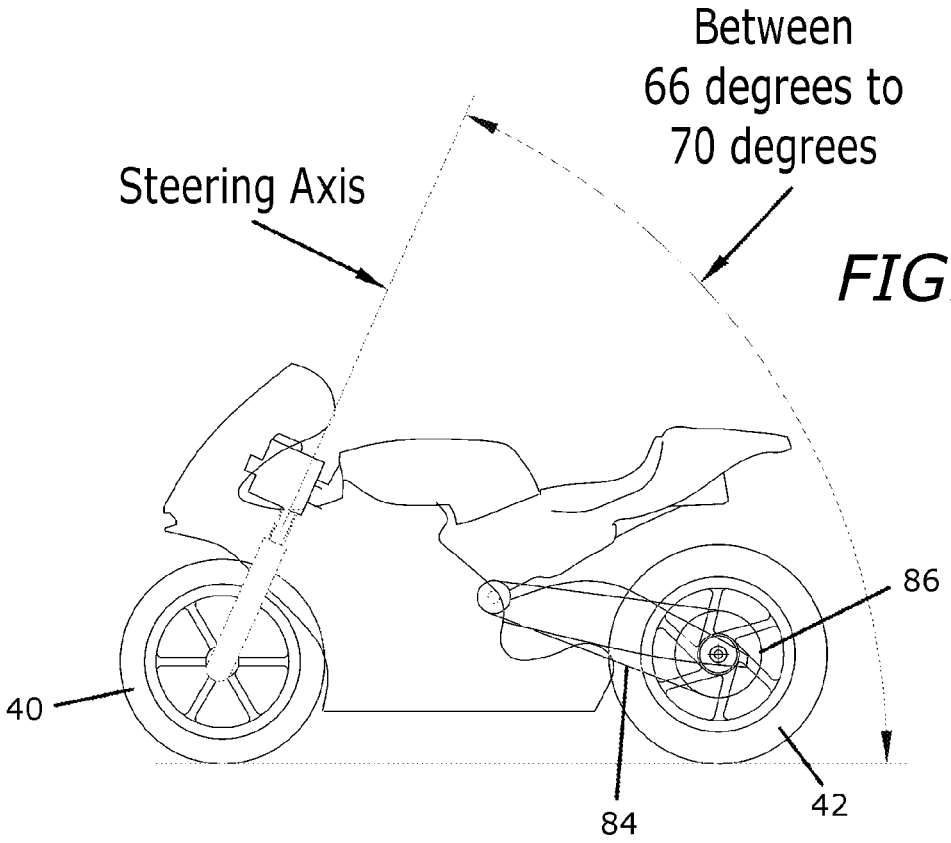
FIG. 5 is a side view of a cycle illustrating in the angular relationship of the handlebar and front wheel support.

This method makes use of angle of lean to move the front tire contact patch towards leaned side. The resultant force of centrifugal force and gravitational force passes this patch area and maintain its balance while turning (FIG. 4). In real full size motorcycle design, the angle between steering axis and horizon is around 55°-65° (FIG. 5). Based on this design, the contact patch shifts a lot when the motorcycle lean its body. That leads to excess turning angle and result in fast falling to one side. A player immediately increases the throttle so as to maintain equilibrium. As a result, auto-stable function is relatively more difficult to achieve.

In one preferred form of the disclosure, the angle was adjusted to about 66 to about 70 degrees. This reduces the turning angle and effectively suppresses the above-mentioned problem to facilitate better control turning performance.

(2) Offset the Center of Gravity Turning Method Principle.

Figure 1F:
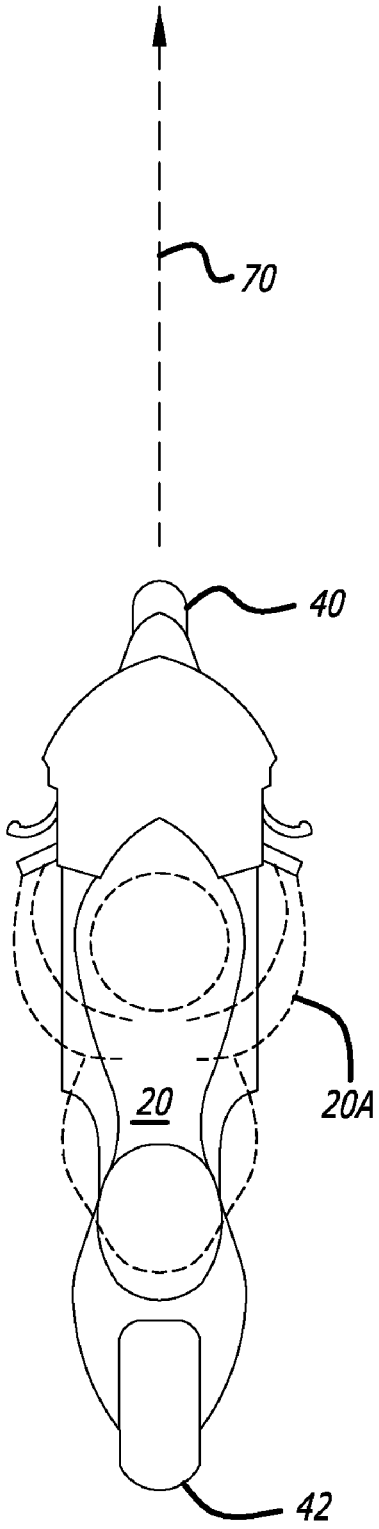
FIG. 1F is a top view of a motorcycle also illustrating a figurine on the bike, the bike being directed in a straightforward direction.
Figure 1G:
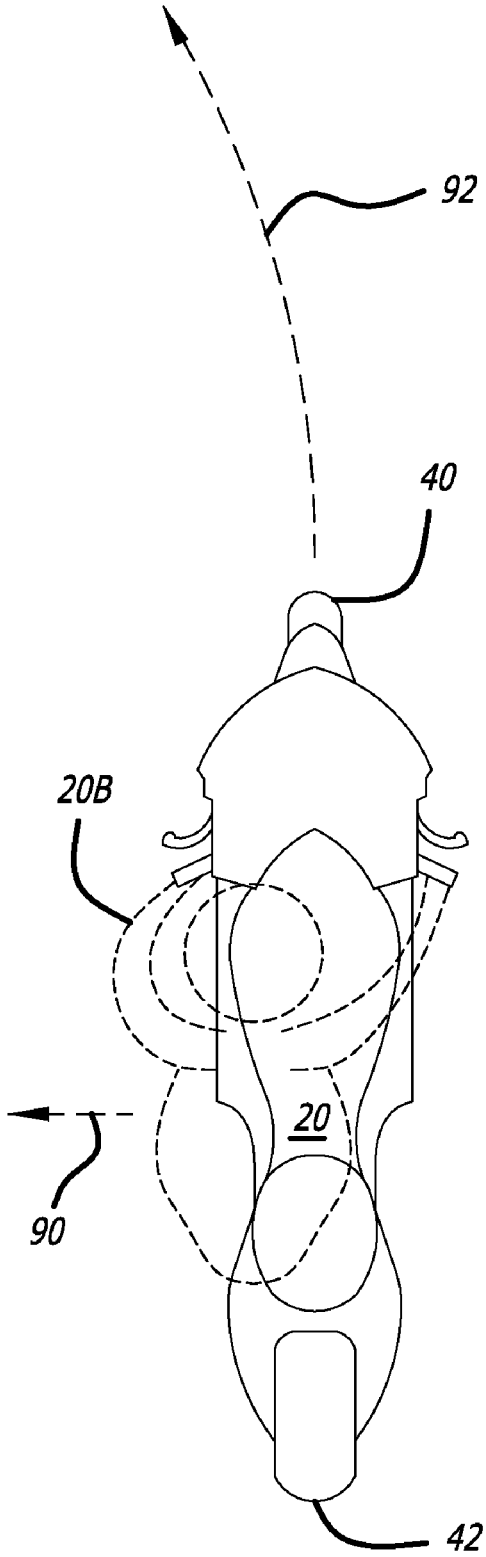
FIG. 1G is a top view of a motorcycle also illustrating a figurine on the bike, the bike being directed in a leftwards direction.

In order to enhance the no handle-bar turning control design, a driver figurine with real driving technique is applied. The driver's body can lean towards one side and the driver's thigh pulled away from the motorcycle's body by a gear system. (FIGS. 1E and 1G). This is compared to the driver longitudinally on the cycle. (FIG. 1F).

The aim of this movement is to significantly shift the overall CG from longitudinal axis to leaned or tilted side and the motorcycle will trend to lean or tilt towards this direction too. Because of gyroscopic precession, the front wheel will then make a turn.

Using this method, facilitates a smoother turning process. This may be obtained without the need to increase the driving speed at initiating the turn which can affect the control process.

The disclosure provides a remote controlled two wheel vehicles that incorporates technology to increase the balancing of the toy and thereby increase the playability, balancing and maneuverability of the toy.

The use of a balancing system increases the possibilities of different radio controlled toys and is implemented into a two wheeled vehicle to increase its balancing and thereby the range of maneuvers it can make during operation.

As such, it is desirable to provide a radio controlled two-wheeled vehicle (e.g., motorbike or bicycle) that is capable of simulating the balance provided by a human rider in a real bicycle, and performing various dynamic and turning movements, while maintaining a balance during operation.

The disclosure provides a radio controlled two wheeled vehicle such as a motorcycle that incorporates technology in order to increase the balancing of the toy and thereby increase the dynamic action and maneuverability of the toy.

The present disclosure includes a two wheel radio controlled vehicle having power, balancing and drive systems to enable a variety of actions. The disposition of a balancing system of the two wheeled vehicle.

The wheels are formed of a relatively heavy material that relatively lowers the center of gravity of the vehicle, and increases the balancing and action motion.

The two-wheeled radio controlled toy vehicle includes a chassis having front and rear ends and a central portion between the ends. The front and rear wheels operatively connected to and providing support for the respective front and rear ends. A front wheel fork assembly is operatively connected to the front end of the body and rotatably supports the front wheel of the cycle which is a motorbike, bicycle or other similar kind of vehicle.

The detailed description considered in conjunction with the accompanying drawings is a further elaboration of the disclosure. The drawings are designed solely for purposes of illustration and not as a definition of the limits of the disclosure.

The radio controlled motorbike 10 includes a figurine 20 disposed on bike 10 and which is molded and jointed to provide a life like look and action. Figurine 20 can be clothed and can include realistic boots.

The bike 10 includes a chassis 12, a radio printed circuit board receiver and electronic system housing 16, a seat 22, a drive assembly 23, a handlebar assembly 24, a front fork 26, with spring suspension, having an axle 28 and a rear fork 29 and rear axle 30 at the base of the seat 22. Wheels 32 and 33 are rotatably mounted to the front and rear axles 28 and 30, respectively.

Drive motors 38 and 39 are preferably disposed under the seat 22 or gas tank structure. A plurality of gears 40 and 41 operatively connects drive motors 38 and 39 to the rear axle 30 and to a crown gear 42. Gears 40, 41 and 42 can be any suitable known type of gearing system, provided that the necessary gear reduction between the drive motors 38 and 39 and the rear axle 30 is achieved. Those of skill in the art will recognize that the arrangement, number and size of gears 40, 41 and 42 are dependent on the motor and wheel size and therefore can be changed without departing from the spirit of the present disclosure.

As shown, radio signals are transmitted from the transmitter 50.

Motors 38 and 39 are capable of speeds in the range of 0-38,000 revolutions per minute (rpm) at no load conditions. The motors 38 and 39 operate in conjunction with the gear ratio of gears 40, 41 and 42 to provide the necessary speed for suitable speeds to be generated.

Those of skill in the art will recognize that the wheels are preferably made of a dense material with the majority of its mass being disposed along its circumference. Preferably, the wheels are made of metal, but may also be made of other suitable known materials. As is known, the weight, distribution of mass, diameter and rotational speed are all important in order to create gyroscopic balancing effect.

Also contained within electronic housing 16 is a circuit board 54 that is electrically connected to on/off switch, batteries 60 and 61, motors 38 and 39 and includes all radio frequency (RF) receiver and control electronics required for operation of bike 10 using a remote control and radio transmitter device. The circuit board allows sufficient surface area for electronic component mounting and does not compromise the housing's realistic overall appearance. There is also a microprocessor and circuitry for signal decoding, steering control, speed control, brake control, and light control, e.g., headlight, brake light, left/right direction indicators.

In accordance with other embodiments, the balancing system can be mounted in other positions on the bike so long as an essentially symmetrical relationship is retained relative to the longitudinal axis.

Those of ordinary skill in the art will recognize that the necessary drive transmissions and/or other assemblies are added to such embodiments to enable independent operation of the balancing system with respect to the operation of the motor drive systems.

The batteries 60 and 61 are removable and can be alkaline or carbon-zinc disposable types or nickel cadmium, nickel metal hydride, lithium ion, or any other suitable known type of rechargeable battery. The batteries 60 and 61 are arranged side by side, and are stacked in a symmetrical relationship relative to the longitudinal axis.

In other embodiments, the batteries 60 and 61 may be rechargeable and non-removable from the bike. In this instance, a charging port can be added to the bike for providing the user with an electrical connection to the batteries for charging the same.

In another motorbike embodiment of the figurine 20 the system of the hips and knees are designed such that the legs are free moving to simulate a motorbike riding style.

The motorcycle 10 includes a fuel tank 70 and a seat 22 in the style of a motocross bike. The motorcycle 10 includes a housing that is disposed between the front and rear wheels and includes a plurality of batteries 60 and 61 and a balancing system. There can be shock absorbers to provide realistic suspension action to the motorcycle during operation.

The disposition of the batteries 60 and 61 in the housing places an increased percentage of the overall weight of the motorcycle in the lower central portion. As such, this design substantially lowers the center of gravity for optimal gyroscopic effect of the toy and thereby increases the operating balancing of the motorcycle, especially at lower speeds.

As shown in FIG. 1E is a representation of the figurine 20 in the normal longitudinal position with the hands of the figurine 20 on the handle bars 24 of the bike tin. There is also shown in the position of the figurine 20 in a rider tilted position which is indicated by 20B. Numeral 20A represents the figurine 20A in the longitudinal position aligned with the front wheel pulley 20 and the rear wheel 42.

Different representations of FIG. 1E are shown in FIGS. 1F, 1G, 1H and 1I. In Figure of the figurine 20 is shown in the longitudinal position 28 where the bike goes in a forward position and is illustrated by arrow 70.

Figure 1H:
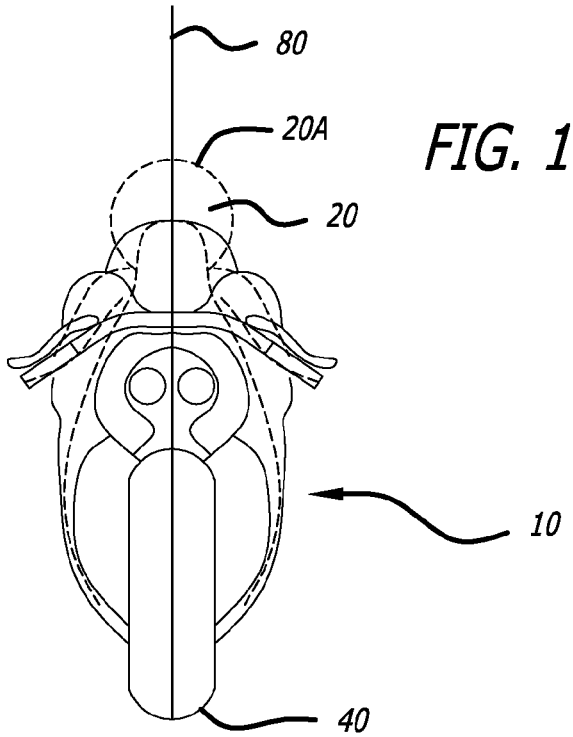
FIG. 1H is a rear view of a motorcycle also illustrating a figurine on the bike, the bike being directed in a straightforward direction.
Figure 1I:
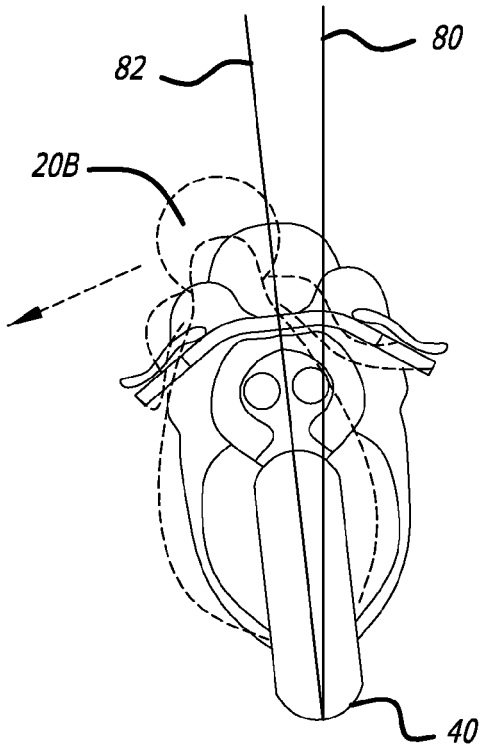
FIG. 1I is a rear view of a motorcycle also illustrating a figurine on the bike, the bike being directed in a tilted sense direction.

FIG. 1H also shows this representation of the figurine 20 in the position 28 aligned longitudinally. In this position, the motorbike 10 is in a varied position along line 80.

In FIG. 1G, the bike tilt is set up to turn towards the left as indicated by arrow 90. The course of action of the bike is indicated by arrow 92. The figurine 20 in this case adopts the position 20B. This relationship also corresponds with the position shown in FIG. 1I. The tilting toward the left is indicated by line 82 and the figurine 20B is adopted in the left tilt location.

As shown in FIG. 2B, there are the two motors 38 and 39 in longitudinal alignment next to each other or location underneath the gas tank position of the motorcycle. The engagement of the gears from the armatures of the motorbike with the gear or the drive system and still drive a belt 34 which in turn goes around a pulley wheel 86 on the rear tire structure 42.

As shown in FIG. 3B, there is a single motor 88 powered by the batteries 60 and 61. The motor is transversely located relative to the longitudinal position of the bike. There is a gear 94 from the armature of motor 88 which drives gear 96 which in turn drives the pulley belt 84 then in turn the pulley 86 associated with the rear wheel 42.

While the apparatus and method have been described in terms of what are presently considered to be the most practical and preferred embodiments, it is to be understood that the disclosure need not be limited to the disclosed embodiments.

As indicated other than a motorbike the system, apparatus and methodology of the present disclosure would operate with other vehicles which would tend to be inherently unstable in a balancing sense and in a sense that turning would render the vehicle to be further unstable from a balance perspective.

It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A toy vehicle comprising:

spaced apart front and rear wheels, the wheels being relatively aligned in a longitudinal axis defined by a straight movement, the front and rear wheels being directed and rotatable along the longitudinal axis, the toy vehicle being steerable in a desired direction under the effect of a tilt relative to a vertical axis passing through the vehicle, wherein the vehicle is representative of a motor cycle, and an offset of a center of gravity (CG) of the vehicle essentially affects turning of the vehicle, and wherein there is a no handle-bar turning control, and including a driver figurine with a body and a representative driving technique, the body being seated on a seat of the motorcycle, and being such that the body above the location of the seat is movable laterally towards one side to affect leaning by moving the body above the seat relatively laterally away from the longitudinal axis, wherein a lateral shifting of the body with an actuator affects a change in the movement laterally and a change in the CG to one side of the longitudinal axis, such that the motorcycle can perform a matching turning, and wherein the actuator for shifting the body includes at least one of an electric motor, electromagnetic device or ionic polymer actuator;

a chassis between the wheels;

a relatively fixed and non-turnable handle-bar relative to the chassis;

the vehicle being capable of being inclined from a relatively vertical position to tilt to the left or right according to a required corresponding turning action to the left or right of the vehicle;

a power transmission system having a double-sided crown gear, and a metal or plastic belt and an embedded gear on the rear wheel, and a dual motor system for generating power, the power being transmitted to a transverse axis by the double-sided crown gear and pinions on the motors, and wherein the power is transmitted to the rear wheel through the belt connected between the embedded gear on the rear wheel and the crown double-sided gear;

a receiver for control signals to regulate the motor, the signals being from a remote RF transmitter; and each of the wheels being formed of a relatively heavy material thereby to have a relatively low center of gravity for the vehicle.

2. A toy vehicle as claimed in claim 1, wherein a front and rear rim of the front and rear wheels, respectively, are a relatively heavy alloy or metal, selectively copper, cast iron or steel thereby to lower the center of gravity.

3. A toy vehicle as claimed in claim 2, wherein these rims rotate at relatively high speed, and create a stable axis of rotation, namely a tendency to maintain its plane of rotation.

4. A toy vehicle as claimed in claim 1, wherein when the wheels are tilted, a twisting moment is induced about an axis at 90 degrees to that of the original tilt effectively by a gyroscopic precession.

5. A toy vehicle as claimed in claim 1, wherein a gyroscopic effect is applied on both wheels, thereby making the performance of the vehicle, the vehicle representing a motorcycle, relatively more stable and easier to balance.

6. A toy vehicle as claimed in claim 1, wherein a symmetric design of actuators permits the motorcycle to perform an effective balance performance at relatively low speed; and including a battery charger.

7. A toy vehicle as claimed in claim 1, wherein the dual motor system uses two relatively small dc motors placed in parallel and symmetrical relationship relative to the longitudinal axis, whereby weights of the motors are relatively symmetrically distributed in left and right positions and the axis of rotation of a drive of each respective motor being parallel relative to the longitudinal axis, and being rotated in an opposite direction relative to the drive of the other motor, and being used to drive the power transmission system, and the motors being aligned in a line between the front and rear of the motorcycle and being located between the front and rear wheels.

8. A toy vehicle as claimed in claim 1, wherein the dual motor system provides stable output torque in high or low speed operation.

9. A toy vehicle as claimed in claim 1, including a constant voltage source for a motor with a selectively variable on/off duty cycle, selectively being Pulse Width Modulation (PWM) being applied to control the speed of the motor, and wherein a lower PWM ratio, a lower power input, and a lower the efficiency of motor provides a torque output.

10. A toy vehicle as claimed in claim 1, wherein in the dual motor system, both motors run relatively fast at high speed operation, and in a low speed operation, both motors are on and off alternatively at medium to high PWM.

11. A toy vehicle as claimed in claim 1 wherein a player operates a transmitter to remotely control the vehicle, the vehicle being a motorcycle, and the motorcycle being relatively stable, the stability being effected by the no handle-bar turning control and wherein an angle of lean permits movement of the front tire contact patch towards the leaned side, and the resultant force of centrifugal force and gravitational force passes this patch area and maintain the balance while turning, and wherein the angle is about 66 to about 70 degrees thereby to reduce the turning angle and permit control turning performance.

12. A toy vehicle as claimed in claim 1, wherein the body movement shifts the overall CG from a longitudinal axis to a leaned side and the motorcycle tends to lean towards the direction, and thereby the use of gyroscopic precession, thereby causing a front wheel to make a turn, such that a relatively smooth turning process is obtained without a need to essentially change the driving speed at initiation of the turn to effect the control process.

13. The vehicle as claimed in claim 1, including a control by at least one of infrared remote control, radio frequency remote control, a programmable control or a battery operated wire control.

14. The vehicle as claimed in claim 1, wherein, the motors being placed in parallel, along the longitudinal axis and rotated in opposite directions, and being used to drive a power transmission system.

15. The vehicle as claimed in claim 1, wherein a relatively heavy front and rear rim for the front and rear wheels respectively for facilitating a low overall CG and create gyroscopic precession effect.

16. The vehicle as claimed in claim 1, including the driver figurine having free hinges between selected limbs, selectively elbows, arms, thighs and knees, and both hands being located on the handle-bar, the handle-bar being unmovable and being mounted on the chassis, such that when the front wheel turns, the position of the handle-bar remains unchanged.

17. The vehicle as claimed in claim 1, wherein an angle between a steering axis and horizontal being between about 66 and about 70°.

18. The vehicle as claimed in claim 1, wherein the motorcycle is an auto-stable system, and is such that no feedback signal is needed for a player to facilitate balance of the motorcycle.

19. The vehicle as claimed in claim 1, wherein the vehicle selectively includes a side car.

20. A toy vehicle comprising:

spaced apart front and rear rotatable wheels, the wheels being relatively aligned in a longitudinal axis defined by a straight movement, the front and rear wheels being directed along the longitudinal axis, the toy vehicle being steerable in a desired direction under the effect of a tilt relative to a vertical axis passing through the vehicle wherein the vehicle is representative of a motor cycle, and an offset of a center of gravity (CG) essentially effects turning control, and including a driver figurine with a body and a representative driving technique, the body being seated on a seat of the motorcycle, and being such that the body above the location of the seat is movable laterally towards one side such that the body is transversely leanable towards one side away from the longitudinal axis, wherein a shifting of the body above the seat transversely to one side of the longitudinal axis with an actuator affects a change in the CG to one side, such that the motorcycle can perform a matching turning; and wherein there is a no handle-bar turning control, and wherein the actuator for shifting the figurine body includes at least one of an electric motor, electromagnetic device or ionic polymer actuator;

a chassis between the wheels;

the vehicle being capable of being inclined from a relatively vertical position to tilt to the left or right according to corresponding turning action to the left or right of the vehicle;

a dual motor system for turning at least the rear wheel; the motors being placed in parallel in relation to the longitudinal axis, and an axis of rotation of a drive of each respective motor being parallel relative to the longitudinal axis; including a power transmission system having a double-sided crown gear, and a metal or plastic belt and an embedded gear on the rear wheel, wherein the dual motor system generates power, the power being transmitted to a transverse axis by the double-sided crown gear and pinions on the motors, and wherein the power is transmitted to the rear wheel through the belt connected between the embedded gear on the rear wheel and the double-sided crown gear;

a receiver for control signals to regulate the motor, the signals being from a remote RF transmitter; and each of the wheels being formed of a relatively heavy material thereby to have a relatively low center of gravity for the vehicle.

21. The vehicle as claimed in claim 20, wherein the drive of each respective motor being rotated in an opposite direction relative to the drive of the other motor.

22. A toy vehicle as claimed in claim 20 wherein the dual motor system uses two relatively small dc motors placed in parallel and symmetrical relationship along the longitudinal axis, whereby weights of the motors are relatively symmetrically distributed in left and right positions and wherein the drive axis of the motors rotate in different directions, the motors being aligned in a line between the front and rear of the motorcycle and being located between the front and rear wheels.

23. A toy vehicle as claimed in claim 21, wherein the dual motor system provides stable output torque in high or low speed operation.

24. A toy vehicle as claimed in claim 20, and including a constant voltage source for the dual motor system with a selectively variable on/off duty cycle, selectively being Pulse Width Modulation (PWM) being applied to control the speed of the motor, and wherein a lower PWM ratio, a lower power input, and a lower the efficiency of motor provides a torque output.

25. A toy vehicle as claimed in claim 21, wherein in the dual motor system, both motors run relatively fast at high speed operation, and in a low speed operation, both motors are on and off alternatively at medium to high PWM.

26. A toy vehicle as claimed in claim 21, wherein the motors are located relatively forwardly of the motorcycle, the forward position being ahead of the seat for the motorcycle.

27. A toy vehicle as claimed in claim 20, including a battery for operating the dual motor system; the battery being placed in a parallel line relative to the motorcycle longitudinal axis.

28. A toy vehicle as claimed in claim 21, including at least two batteries for operating the dual motor system; the batteries being placed in a parallel line relative to the motorcycle longitudinal axis.

29. A toy vehicle as claimed in claim 7, including at least two batteries for operating the dual motor system; the batteries being placed in a parallel line relative to the motorcycle longitudinal axis.

30. The vehicle as claimed in claim 1, wherein the front wheel is relatively mounted in alignment with the longitudinal axis and wherein there is no additional actuator or mechanism required to change a direction of front wheel along a steering axis.

31. The vehicle as claimed in claim 20, wherein the front wheel is mounted in relatively mounted in alignment with the longitudinal axis and wherein there is no additional actuator or mechanism required to change a direction of front wheel along a steering axis.

32. The vehicle as claimed in claim 20, including a relatively fixed and non-turnable handle-bar relative to the chassis, the handle bar being unconnected with the front wheel.

33. The vehicle as claimed in claim 1 wherein the handle bar is unconnected with the front wheel.

34. The vehicle as claimed in claim 1 including a center of gravity shift outside the line of symmetry of the chassis, such shift being for effecting turning.

35. A toy motorcycle vehicle comprising:

spaced apart front and rear wheels, the wheels being relatively aligned in a longitudinal axis defined by a straight movement, the front and rear wheels being directed along the longitudinal axis, including the wheels being free to rotate, wherein the vehicle is representative of a motor cycle, the toy vehicle being steerable in a desired direction under the effect of a tilt relative to a vertical axis passing through the vehicle and an offset of a center of gravity (CG) essentially affects turning, and wherein there is a no handle-bar turning control, and including a driver figurine with a body and a representative driving technique, such that the body is seated on a seat of the motorcycle, and being such that the body above the location of the seat is movable laterally towards one side to affect leaning by moving the body relatively laterally to the longitudinal axis, wherein a shifting of the body with an actuator effects a change in CG to one side, such shift being the sole action whereby the motorcycle performs a turning corresponding to the degree of shift and change of the CG, and wherein the actuator for shifting the body includes at least one of an electric motor, electromagnetic device or ionic polymer actuator;

a chassis between the wheels;

a relatively fixed and non-turnable handle-bar relative to the chassis, such that the handlebar are inoperative to effect a turning change;

the vehicle being capable of being inclined from a relatively vertical position to tilt to the left or right according to corresponding turning action to the left or right of the vehicle;

a dual motor system for turning the rear wheel, the motors being aligned in a line between the front and rear of the motorcycle and being located between the front and rear wheels, including a power transmission system having a double-sided crown gear, and a metal or plastic belt and an embedded gear on the rear wheel, and the dual motor system generates power, the power being transmitted to a transverse axis by the double-sided crown gear and pinions on the motors, and wherein the power is transmitted to the rear wheel through the belt connected between the embedded gear on the rear wheel and the crown double sided gear;

a receiver for control signals to regulate the motor, the signals being from a remote RF transmitter; and each of the wheels being formed of a relatively heavy material thereby to have a relatively low center of gravity for the vehicle.

36. The vehicle as claimed in claim 34, including a dual battery supply, the motors being placed in parallel relative to the longitudinal axis and an axis of rotation of a drive of each respective motor being parallel relative to the longitudinal axis, and being rotated in opposite direction relative to the drive of the other motor, and being used to drive the power transmission system, the motors, batteries and the transmission system being located no higher than a top of the wheels of vehicle, the motors being aligned in a line between the front and rear of the motorcycle and being located between the front and rear wheels.

37. The vehicle as claimed in claim 1, wherein the motors are located such that rotating drive shafts of the motors are substantially horizontal.

38. The vehicle as claimed in claim 22, wherein the motors are located such that rotating drive shafts of the motors are substantially horizontal.

39. The vehicle as claimed in claim 34, wherein the motors are located such that rotating drive shafts of the motors are substantially horizontal.

40. A toy vehicle comprising:

spaced apart front and rear wheels, the wheels being relatively aligned in a longitudinal axis defined by a straight movement, the front and rear wheels being directed and rotatable along the longitudinal axis, the toy vehicle being steerable in a desired direction under the effect of a tilt relative to a vertical axis passing through the vehicle, wherein the vehicle is representative of a motor cycle, and an offset of a center of gravity of (CG) the vehicle essentially affects turning of the vehicle, and wherein there is a no handle-bar turning control, and including a driver figurine with a body and a representative driving technique, the body being seated on a seat of the motorbike, and being such that the body above the location of the seat is movable laterally towards one side to affect leaning by moving the body above the seat relatively laterally away from the longitudinal axis, wherein a lateral shifting of the body with an actuator affects a change in the movement laterally and a change in the CG to one side of the longitudinal axis, such that the motorcycle can perform a matching turning, and wherein the actuator for shifting the body includes at least one of an electric motor, electromagnetic device or ionic polymer actuator;

a chassis between the wheels;

a relatively fixed and non-turnable handle-bar relative to the chassis;

the vehicle being capable of being inclined from a relatively vertical position to tilt to the left or right according to a required corresponding turning action to the left or right of the vehicle; wherein an angle between steering axis and horizontal being between a about 66 and about 70°, a motor for turning at least one wheel;

a receiver for control signals to regulate the motor, the signals being from a remote RF transmitter; and each of the wheels being formed of a relatively heavy material thereby to have a relatively low center of gravity for the vehicle.

* * * * *